US010280616B2

(12) United States Patent
Douglas

(10) Patent No.: US 10,280,616 B2
(45) Date of Patent: May 7, 2019

(54) COMPOSITE DISC AXIAL DAMPENER FOR BUILDINGS AND STRUCTURES

(71) Applicant: Wasatch Composite Analysis LLC, Park City, UT (US)

(72) Inventor: Timothy A. Douglas, Park City, UT (US)

(73) Assignee: Wasatch Composite Analysis LLC, Park City, UT (US)

( * ) Notice: Subject to any disclaimer, the term of this patent is extended or adjusted under 35 U.S.C. 154(b) by 0 days.

(21) Appl. No.: 15/948,441

(22) Filed: Apr. 9, 2018

(65) Prior Publication Data

US 2018/0223531 A1 Aug. 9, 2018

Related U.S. Application Data

(62) Division of application No. 15/215,110, filed on Jul. 20, 2016, now Pat. No. 9,963,878.

(60) Provisional application No. 62/194,373, filed on Jul. 20, 2015.

(51) Int. Cl.

| | |
|---|---|
| ***E04H 9/02*** | (2006.01) |
| ***E04C 3/00*** | (2006.01) |
| *E04C 3/02* | (2006.01) |

(52) U.S. Cl.

CPC ..... *E04C 3/00* (2013.01); *E04H 9/024* (2013.01); *E04C 2003/026* (2013.01)

(58) Field of Classification Search

CPC ..... E04C 3/00; E04C 2003/026; E04H 9/024; E04H 9/022; E04H 9/14; E04H 9/04; E04G 25/02

USPC ..... 52/167.1, 167.3, 167.6, 167.7, 167.8

See application file for complete search history.

(56) References Cited

U.S. PATENT DOCUMENTS

| | | | | | |
|---|---|---|---|---|---|
| 3,606,704 | A * | 9/1971 | Denton | E04F 15/024 | 248/619 |
| 3,856,242 | A * | 12/1974 | Cook | F16F 1/32 | 248/548 |
| 4,019,398 | A * | 4/1977 | Wesemeier | F16H 55/56 | 474/46 |
| 4,200,256 | A * | 4/1980 | Thiel | F16F 7/12 | 248/548 |
| 4,304,956 | A * | 12/1981 | Kishida | H01B 17/16 | 174/152 R |
| 4,448,000 | A * | 5/1984 | Manuccia | B01J 3/03 | 277/641 |
| 4,605,106 | A * | 8/1986 | Fyfe | E01D 19/04 | 14/73.5 |
| 5,797,228 | A * | 8/1998 | Kemeny | E04H 9/022 | 248/632 |

(Continued)

FOREIGN PATENT DOCUMENTS

WO WO-2013062555 A2 * 5/2013 ..... F16F 1/32

*Primary Examiner* — Brent W Herring

(74) *Attorney, Agent, or Firm* — Peter A. Sullivan; Erik Huestis; Foley Hoag LLP

(57) ABSTRACT

A seismic axial dampener device is constructed of a multitude of composite or metallic conical compression discs and an exo-structure capable of dampening both tension and compression cycles of a building structure due to a seismic, explosion, or wind event. The dampener reacts and dampens the loading in both tension and compression along the axis of the cross brace in linear-elastic bending, creating internal hoop stress, and not through shear of the dampener device.

10 Claims, 16 Drawing Sheets

(56) References Cited

U.S. PATENT DOCUMENTS 5,833,776 A * 11/1998 Labesky ..... F16B 43/00 148/580
5,946,866 A * 9/1999 Weglewski ..... E04H 9/022 52/167.1
6,102,382 A * 8/2000 Labesky ..... F16B 43/00 267/161
6,233,884 B1 * 5/2001 Tipping ..... E04H 9/02 52/167.1
7,584,578 B2 * 9/2009 Hilmy ..... E04H 9/02 52/167.1
8,297,011 B2 * 10/2012 Quick ..... E05C 19/003 248/354.3
9,080,339 B2 * 7/2015 Hayes ..... F16B 7/00
9,289,238 B2 * 3/2016 Ross ..... A61B 17/60
9,644,384 B2 * 5/2017 Powell ..... E04H 9/021
9,683,365 B2 * 6/2017 Haque ..... F16F 15/085
9,745,741 B2 * 8/2017 Hayes ..... E04B 1/985
2007/0200467 A1 * 8/2007 Heydt ..... H04R 19/02 310/311
2008/0092460 A1 * 4/2008 Hilmy ..... E04H 9/02 52/167.8
2010/0170170 A1 * 7/2010 Quick ..... E05C 19/003 52/202
2014/0069400 A1 * 3/2014 Nebergall ..... F41B 5/123 124/25
2014/0259993 A1 * 9/2014 Hayes ..... F16B 7/00 52/167.1
2015/0000228 A1 * 1/2015 Dusicka ..... E04O 3/00 52/835
2015/0233113 A1 * 8/2015 Ueno ..... E04B 1/98 52/167.1
2015/0305776 A1 * 10/2015 Ross ..... A61B 17/60 606/56
2016/0237711 A1 * 8/2016 Powell ..... E04H 9/021
2016/0265217 A1 * 9/2016 Hayes ..... E04B 1/985
2016/0296740 A1 * 10/2016 Adams ..... A61M 39/10
2016/0310168 A1 * 10/2016 Ross ..... A61B 17/60
2016/0326742 A1 * 11/2016 Haque ..... F16F 15/085
2017/0298646 A1 * 10/2017 Powell ..... E04H 9/021

* cited by examiner

COMPOSITE DISC AXIAL DAMPENER FOR BUILDINGS AND STRUCTURES

CROSS-REFERENCE TO RELATED APPLICATIONS

This application is a Divisional of application Ser. No. 15/215,110, filed Jul. 20, 2016, which claims the benefit of Provisional Application No. 62/194,373, filed Jul. 20, 2015, both of which are hereby incorporated by reference.

BACKGROUND

Embodiments of the present disclose relate to protecting structures from dynamic loading, and more specifically, to composite disc axial dampeners for buildings and structures.

When a structural member is excited by a horizontal external force, shear or similar horizontal movement may occur. Shear, especially in high building structures or towers may have serious impact on the conditions of the structure or even result in a collapse.

Dampeners play an important role in the protection of structures, e.g., houses or similar building structures, and they exist in numerous variants. Dampeners may dampen the motion by means of a frictional force between two moving parts attached between structural members of the building or by means of a fluid being forced to flow between two chambers through a restricted tube. Such dampeners act to dampen the seismic, explosion, and wind loading shear, and not an axial cross brace manner. Some dampers are actively changing the dampening effect corresponding to external conditions, and other dampers are passive dampers having a constant dampening characteristic.

An example of a passive dampener is the use of a Buckling Restrained Brace (BRB) which incorporates a metallic core or center axial member passing through an exterior buckling-constraining concrete cylinder. Such dampeners are heavy, costly to produce, and even more costly to assemble into a structural member of a building. In addition, the BRB dampener result in the metallic core experiencing plastic deformation and strain hardening resulting in permanent set and overall length change to due reacting the large compression and tension loads during a dampening event. The dampening event is a result of the horizontal movement that may occur, e.g., if the foundation of a building is displaced by an earthquake or by similar vibrations transmitted through the ground. Since the BRB dampeners are not self-righting, due to permanent set, the BRB dampeners must be replaced or repositioned to level the affected building or structure.

There is, therefore, a need in the art for an improved dampener that will handle these large compression and tension loads that are lighter weight, do not experience permanent set, are self-centering or self-righting after a dampening event, and have improved dynamic response due to the integration of composite materials. Accordingly, the present disclosure provides for storing the energy of the seismic, explosion, or wind event in the form of linear bending of the discs, instead of plastic deformation of the restrained core.

BRIEF SUMMARY

The present application relates generally to a dampener and a method for protecting buildings and similar structural systems from dynamic loading such as loading caused by earthquakes, strong winds or machine vibrations, more specifically, to dampeners constructed of non-metallic materials, with the dampener constructed from structural members interconnected between pinned rotational or welded/bolted joints. These structural members are placed into tension and compression as the dampener is dissipating the energy caused by the earthquake, explosion, strong wind, or machine vibration. Due to the dampening of the joints, relative movement between the structural elements is dampened. In particular, the dampener is useful for base isolation, e.g., in order to allow a building or a machine to move in dampened movements relative to its foundation.

It is an object of the present disclosure to provide a dampener for dampening substantially horizontal movement or shear in structures such as shear in buildings. The present disclosure provides a dampening device that is constructed of composite carbon/epoxy or metallic compression discs, stacked in series and parallel, concentric to a composite and/or metallic structure and housing, which is located between two end fittings pinned, bolted, or welded to the horizontal and vertical members of the building or structure.

According to embodiments of the present disclosure, an axial dampening device is provided. The device comprises a plurality of conical discs disposed axially to form a disc stack.

According to embodiments of the present disclosure, an axial dampening device is provided. A plurality of discs is disposed coaxially to form a disc stack. Each disc has a concave surface and a substantially perpendicular convex surface. The discs are disposed in pairs such that the convex surfaces of alternating pairs are oriented in substantially opposed directions.

DETAILED DESCRIPTION

Figure 1:
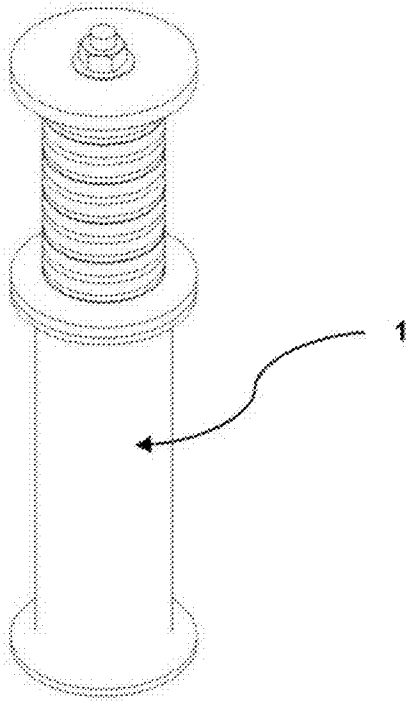
FIG. 1 depicts a composite/metallic disc axial dampener for buildings and structures according to embodiments of the present disclosure.
Figure 2A:
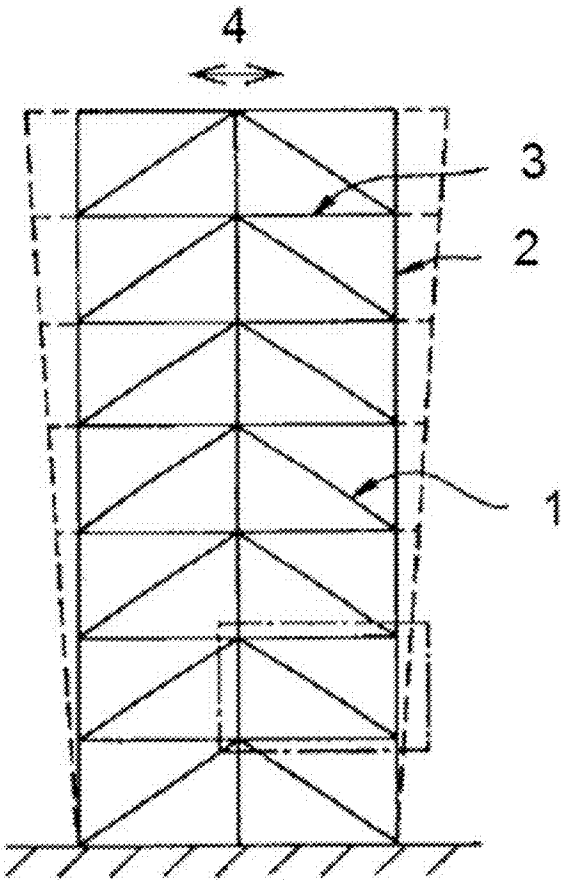
FIGS. 2A-D illustrates integration of disc axial dampener braces into a multi-floor building according to embodiments of the present disclosure.
Figure 2B:
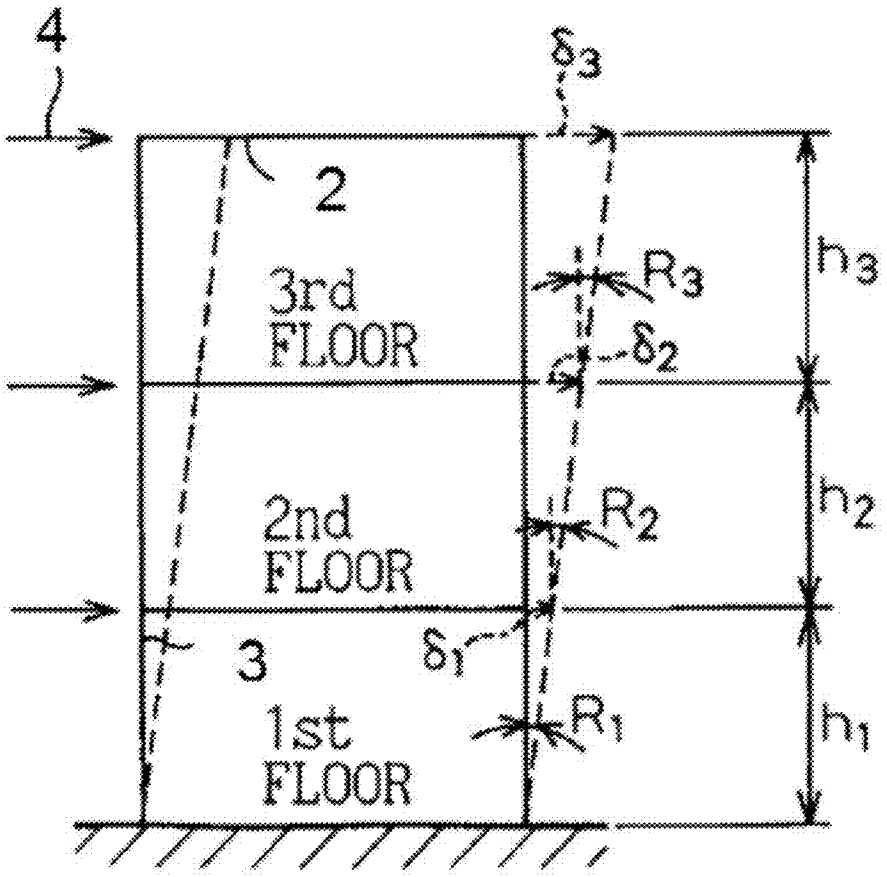
Figure 2C:
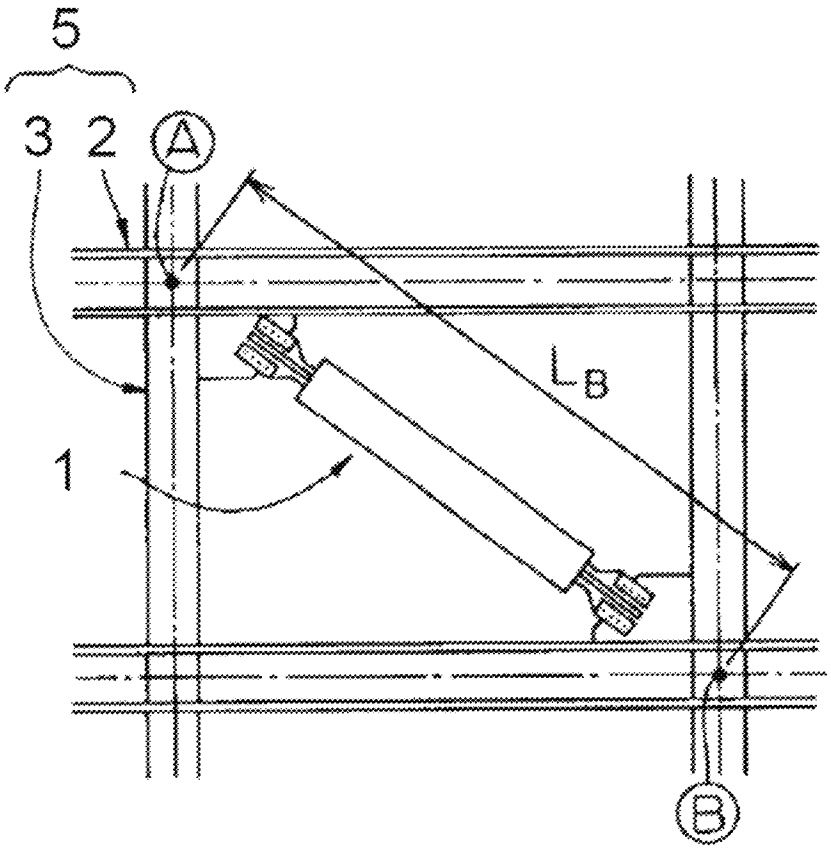
Figure 2D:
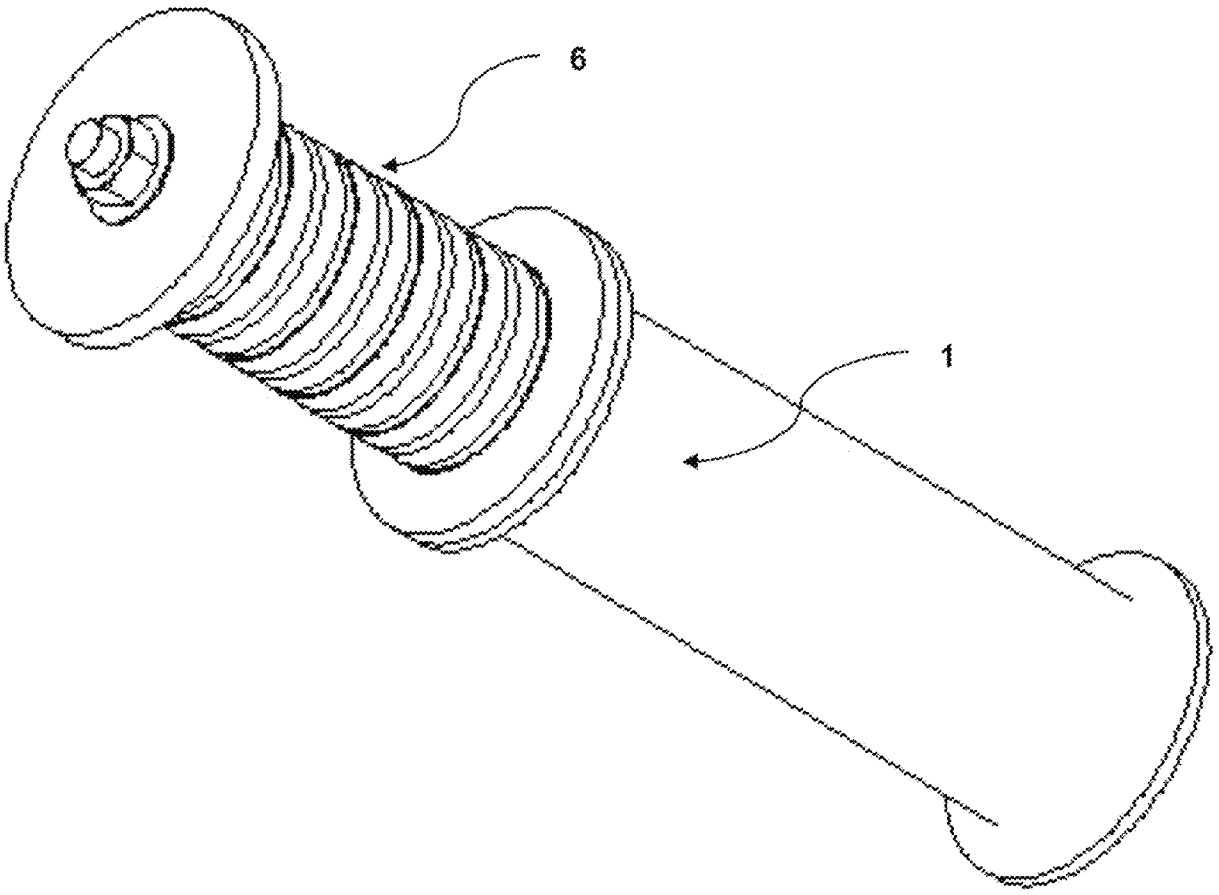

For a more complete understanding of the present disclosure and its advantages, reference is now made to the following description taken in conjunction with the accompanying drawings, in which like reference numerals represent like parts. The various embodiments disclosed herein are by way of illustration only and should not be construed in any way to limit the scope of the disclosure. Those skilled in the art will understand that the principles of the present disclosure may be implemented in any suitably arranged composite disc axial dampener that dampens substantially horizontal movement or shear in structures such as shear in buildings, without permanent set, and are self-centering or self-righting. As disclosed herein, the notational representation of cross sectional geometry presented are not intended to limit the sectional geometry to be rectangular in nature. Curvilinear and spline cross sectional contours, with varying thicknesses, are likewise suitable and afford various embodiments with a non-linear and tailorable stiffness response.

FIG. 1 is an isometric view of a cylindrical composite/metallic disc axial dampener according to an exemplary embodiment of the present disclosure. Composite disc dampener 1 is constructed of composite and metallic materials and is integrated into a building structure to dampen the energy of a loading event.

FIG. 2 illustrates how a multiplicity of composite discs and axial dampener 1 braces are integrated into a building in order to react the ground induced lateral seismic, explosion, and wind loading. The dampener (shown in FIG. 2D), once fitted with end connections, spans the diagonal distance between the corners of the horizontal 2 and vertical 3 structural members of the each building floor, as shown in FIG. 2A. As the foundation of the building oscillates from the cyclic loading, a reaction force 4 is generated at each floor level, with the displacement increasing as one moves up the structure, illustrated by FIG. 2B. The brace end connections are bolted, pinned, or welded to the intersection 5 of the horizontal 2 and vertical 3 building structural members in FIG. 2C. The distance between Point A and Point B is considered the brace length ($L_B$), and the expansion and contraction forces and displacements of this link in the structure are dampened by the disc dampening brace 1 as the building distorts about Points A and B. The energy of this seismic, explosion, or wind motion is absorbed and released by the discs 6 (FIG. 2D) internal to the dampener 1, thus resulting in the dampening of the entire building structure, which will maintain the build integrity and allow the structure to survive the loading event.

Figure 3:
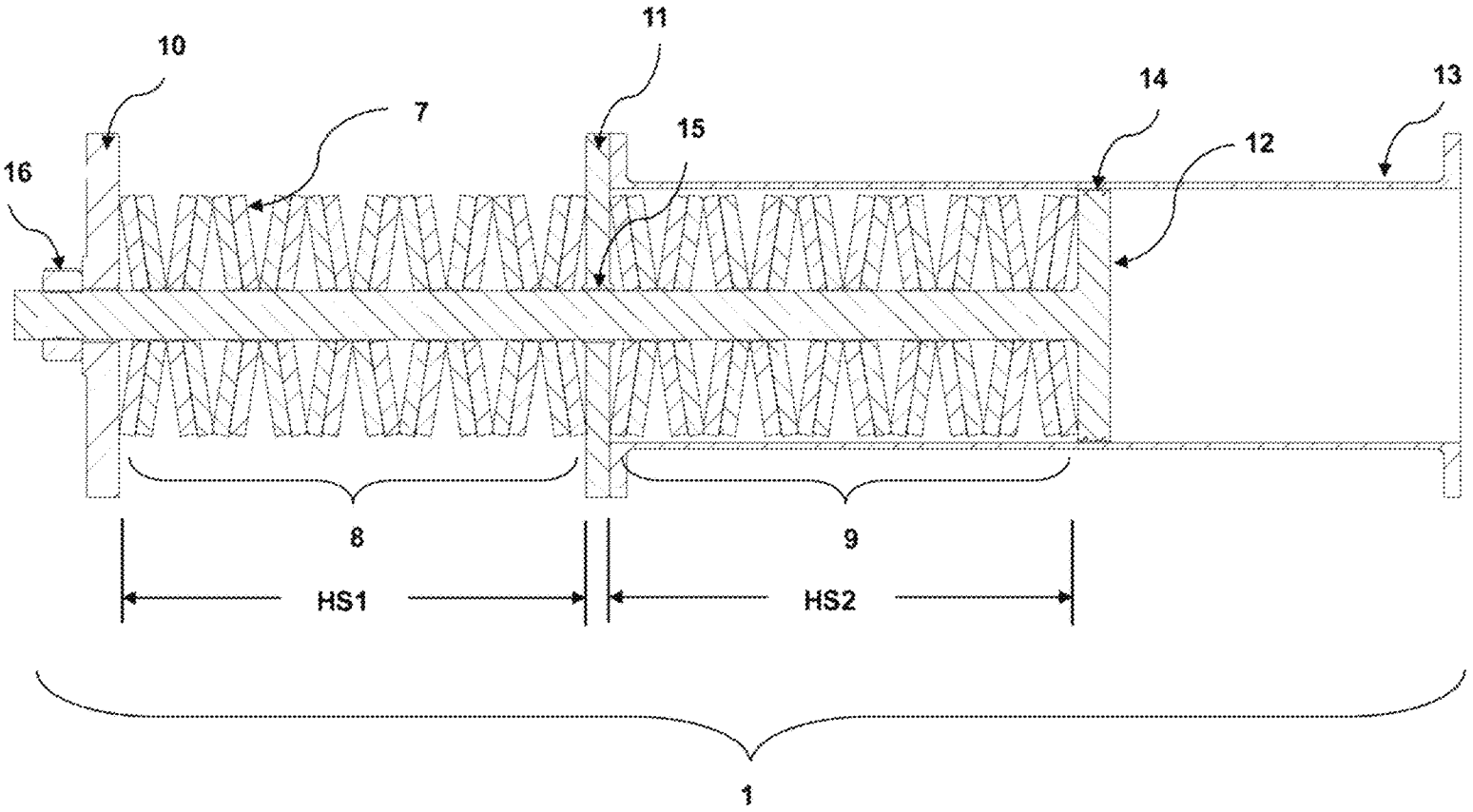
FIG. 3 depicts a single disc axial dampener for buildings and structures according to embodiments of the present disclosure.

FIG. 3 shows the internal structures and details of a single disc stack configuration of an axial dampener 1. This embodiment includes the series and parallel disc stack 8 which is compressed during a compression cycle, and the disc stack 9 which is compressed during a tensile cycle. In some embodiments, a large Belleville washer is used as a compression disc.

A multitude of discs 7 manufactured from a combination of carbon, aramid, or glass fibers within a polymer resin matrix constituting the composite material. These compression discs are not limited to composite materials, but may also be fabricated from metallic materials.

The combination of these discs assembled in alternating series and parallel configurations affords the compression disc stack 8 and the tension disc stack 9 of the embodiment of the present disclosure. By alternating the discs in parallel and series the brace system stiffness ($K_T$) and displacement ($\delta_T$) or travel of the dampener can be tailored to meet the specific requirements for the brace load capacity and motion. In addition, the use of curvilinear and spline cross sectional contours, with varying thicknesses, enable a non-linear and tailorable stiffness response. The system stiffness of a spring stack is calculated by Equation 1. The force (F) a rectangular cross section single disc can react is estimated by Equation 2, while the displacement (δ) of a single disc is estimated by Equation 3.

$$K_T = \frac{k}{\sum_{i=1}^{g} \frac{1}{N_i}} \qquad \text{Equation 1}$$

$$F = \frac{T_d^2}{1 - \frac{2}{3}\left(\frac{R_i}{R_o}\right)}\sigma \qquad \text{Equation 2}$$

$$\delta = \frac{0.65R_o^2}{ET_d\left(1 - \frac{2}{3}\left(\frac{R_i}{R_o}\right)\right)}\sigma \qquad \text{Equation 3}$$

Figure 5:
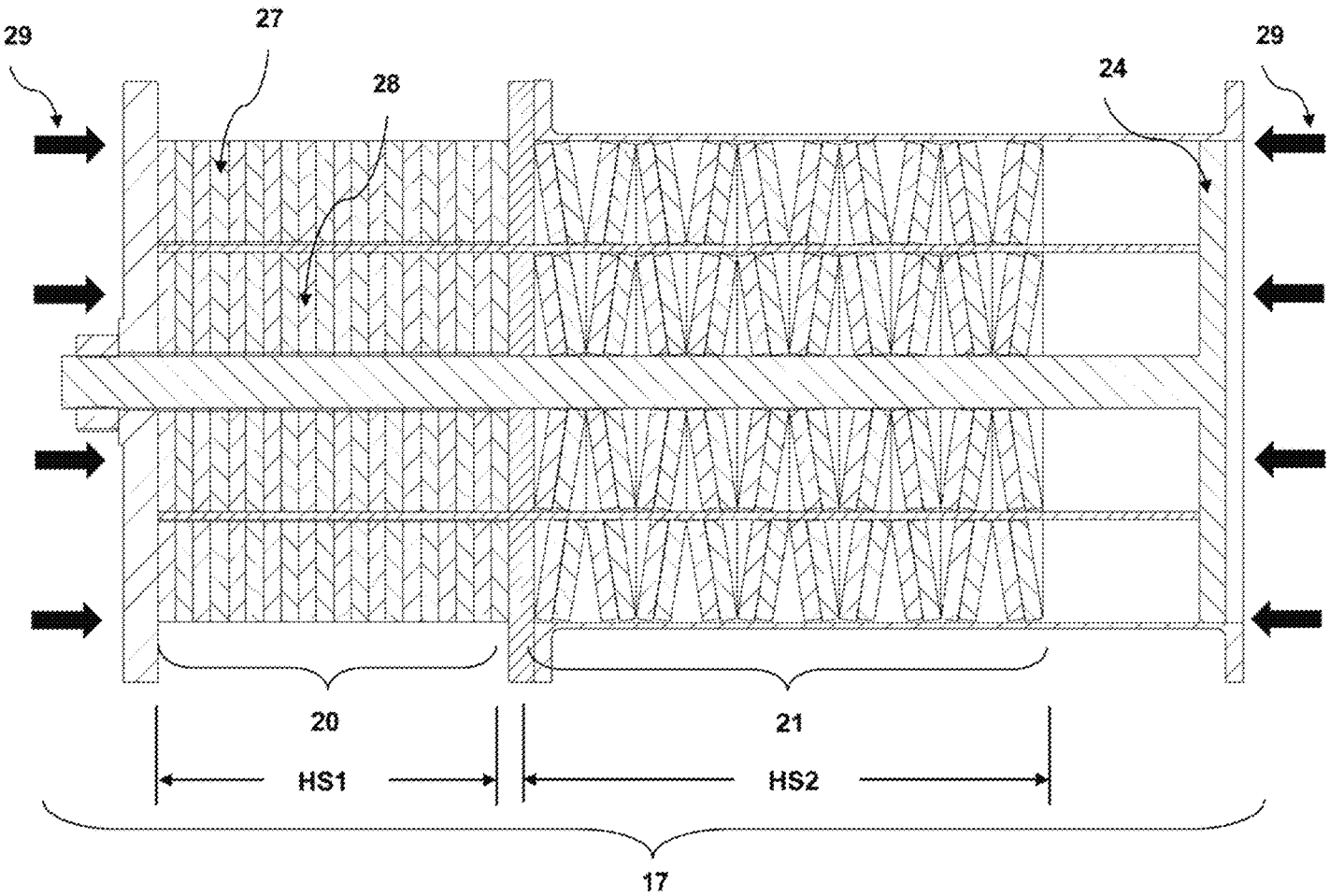
FIG. 5 depicts a fully compressed dual concentric dampener according to embodiments of the present disclosure.

In the above equations:

$N_i$=the number of discs in the i-th group
g=the number of groups the stack
k=the spring rate of one disc
F=force reacted by a single disc
$T_d$=disc thickness
σ=tensile hoop stress in disc
$R_i$=disc inside radius
$R_o$=disc outside radius
δ=displacement by a single disc
E=Flexural Modulus of disc material
$T_d$=disc thickness
σ=tensile stress in disc
$R_i$=disc inside radius
$R_o$=disc outside radius The dampener and brace design with its ease of assembly, variability of disc dimensions and cross sectional contours, thickness, and spring stacking height, affords nearly infinite tailorability of the present disclosure to react the various tension and compression loadings for each floor of the building. As a compression cycle begins, the spring stack height (HS1), or the distance between the pre-load end plate 10 and center plate 11, decreases thus compressing the compression spring 8. The tension end plate 12 is allowed to freely move, along its axis, through the axis of the center plate 11. The energy necessary to compress the spring stack is absorbed by the bending of each individual composite disc which is elastically deformed. The design of disc thickness and geometry is such that the disc material elastically deforms and does not experience plastic deformation or permanent set. The deformation of this disclosed compression cycle is illustrated in FIG. 5, for the alternate dampener embodiment 17.

Figure 6:
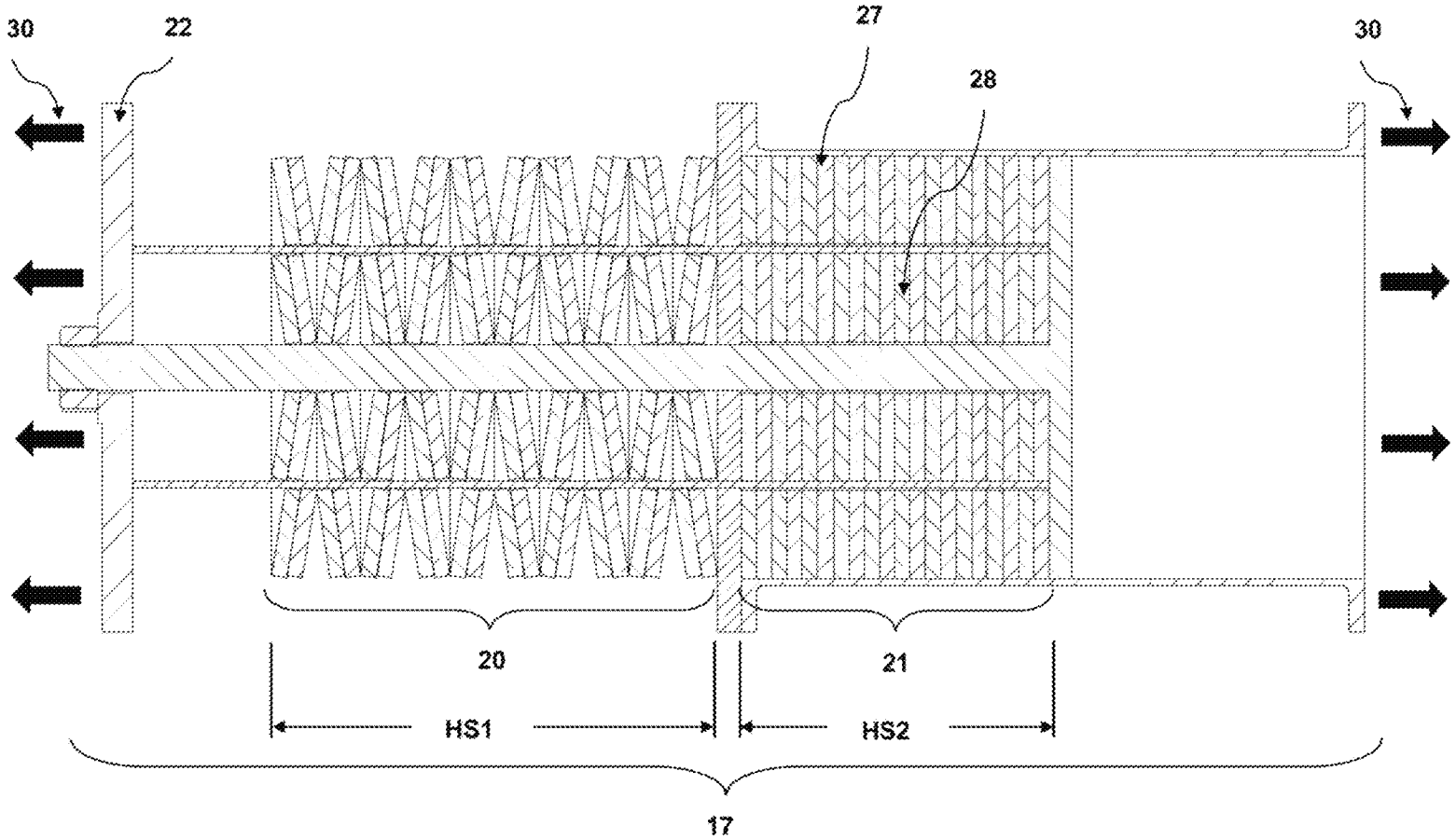
FIG. 6 depicts a fully extended dual concentric dampener according to embodiments of the present disclosure.

As a tension cycle begins, the spring stack height (HS2), or the distance between the center plate 11 and the tension piston 12 decreases thus compressing the tension spring 9. As with the compression spring, the energy necessary to compress the tension spring stack is absorbed by the bending of each individual composite disc which is elastically deformed. The deformation of this disclosed tension cycle is illustrated in FIG. 6, for the alternate dampener embodiment 17.

The present dampener disclosure must be capable of resisting the induced bending moment and beam shear load from the bolted or welded brace attachments to corner or intersection of the horizontal and vertical members of the building structure. The current embodiment will react the loading through the tension piston bearing surface 14, manufactured from a low friction polymer, with the outer housing 13, and the center plate sleeve bearing 15 to the shaft of the tension piston 12. The center plate sleeve bearing 15 is also manufactured from a low friction polymer, designed to allow the axial oscillations of the tension piston shaft. These bearing surfaces maintain the alignment of dampener and remove any shear loading of the spring discs and spring stacks.

An additional embodiment for the current disclosure is the preload compression of both tension spring 8 and compression spring 9. The threaded lock nut 16 is tightened to pre-compress both disc stacks providing dampening system rigidity for brace installation and building wind loading resistance.

Figure 4:
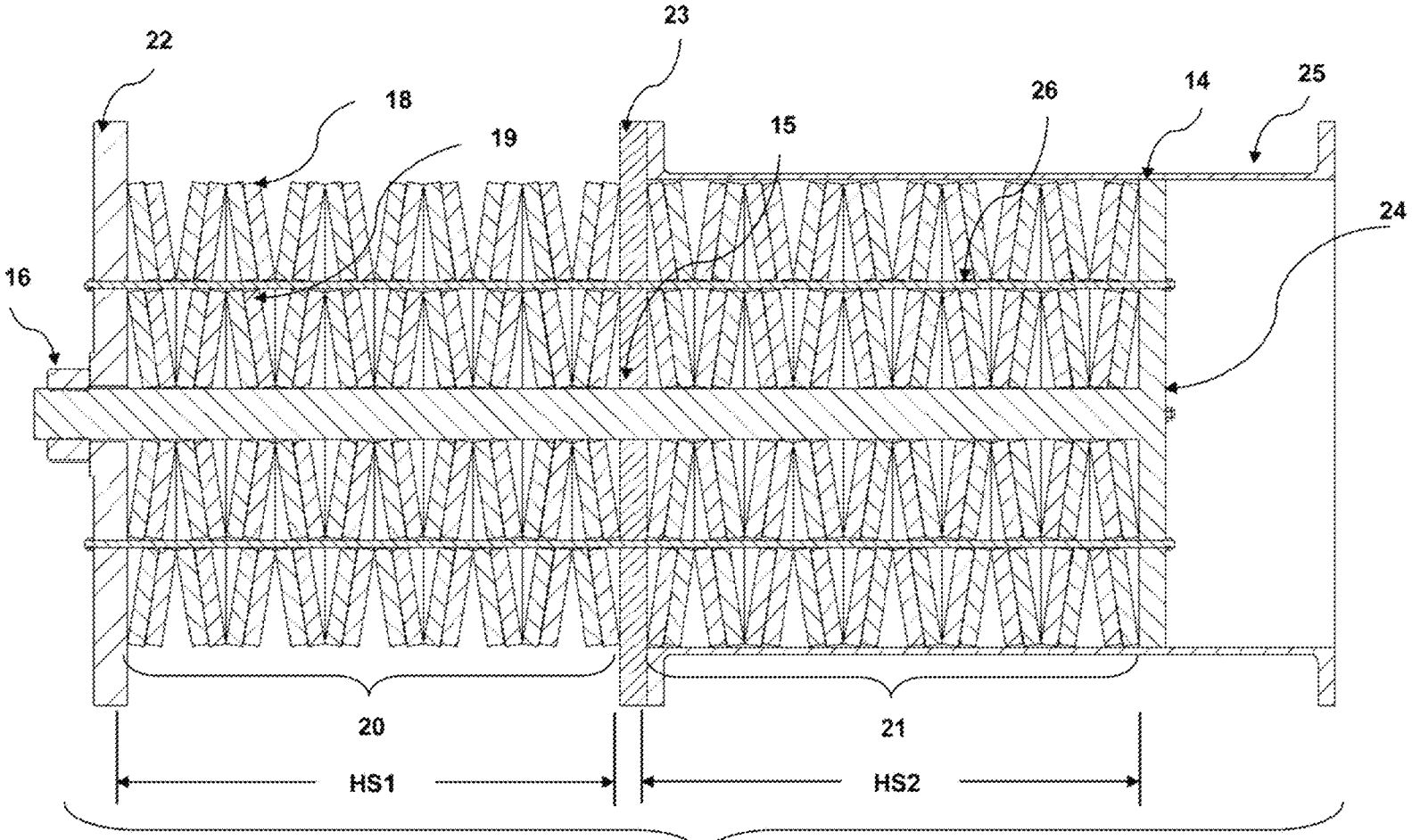
FIG. 4 depicts a dual concentric disc axial dampener for buildings and structures according to embodiments of the present disclosure.

FIG. 4 shows an alternate design configuration of a dual concentric disc stack axial dampener 17. This embodiment includes the series and parallel concentric disc stack 20 which is compressed during a compression cycle, and the concentric disc stack 21, which is compressed during a tensile cycle. This embodiment incorporates multiplicity of dual concentric discs, with outer disc 18 and inner disc 19. The functionality of the dual concentric disc dampener is similar to the single dampener 1, with some changes to the components and the operation of the alternate disclosure. Various alternate configurations provide for an increased load capacity of the disclosed embodiment. A multiplicity of concentric disc may be employed for increasing load capacity, and therefore the present disclosure is not limit to only dual concentric discs.

As in prior embodiments, there exists a tension disc stack 20 and a compression disc stack 21; however the total brace load is shared between the two sets of concentric discs, thus increasing the overall dampener stiffness and disturbing the reaction load throughout the dampener core.

The following dual dampener 17 components function similarly to the single dampener 1, and have only been increased in size: tension end plate 22, center plate 23, tension piston 24, and outer housing 25. The threaded lock nut 16 is tightened to pre-compress both disc stacks providing dampening system rigidity for brace installation and building wind loading resistance. Although not illustrated in FIG. 4, the center plate sleeve bearing 15, and the tension piston bearing surface 14, manufactured from a low friction polymer, are embodiments of the dual dampener 17.

In the dual concentric disc dampener 17, an additional embodiment has been incorporated to maintain the alignment of the outer discs 18. A multitude of alignment rods or curvilinear plates 26 are incorporated to maintain the concentric position of the outer discs. These rods or plates are allowed to freely move through the center plate 23. They are fasten to both the tension end plate 22 and the tension piston 24, and will move with the tension piston.

FIGS. 5-6 illustrate operational details and geometric distortions according to various embodiments of the present disclosure for compression and tension cycling. FIG. 5 illustrates the Dual Concentric Dampener 17 in the displacement state due to exposure to a compressing load cycle 29. FIG. 6 illustrates the Dual Concentric Dampener 17 in the displacement state due to exposure to a tension load cycle 30.

As the compression cycle forces 29 are applied to the device during a loading event, the disc stack 20 is compressed and the individual concentric discs 27 and 28 are elastically distorted absorbing and dampening the energy. This compression along the axis of the embodiment, in linear-elastic bending, results in induced hoop stress within each individual disc of the disc stack 20, as the discs are distorted.

Figure 7:
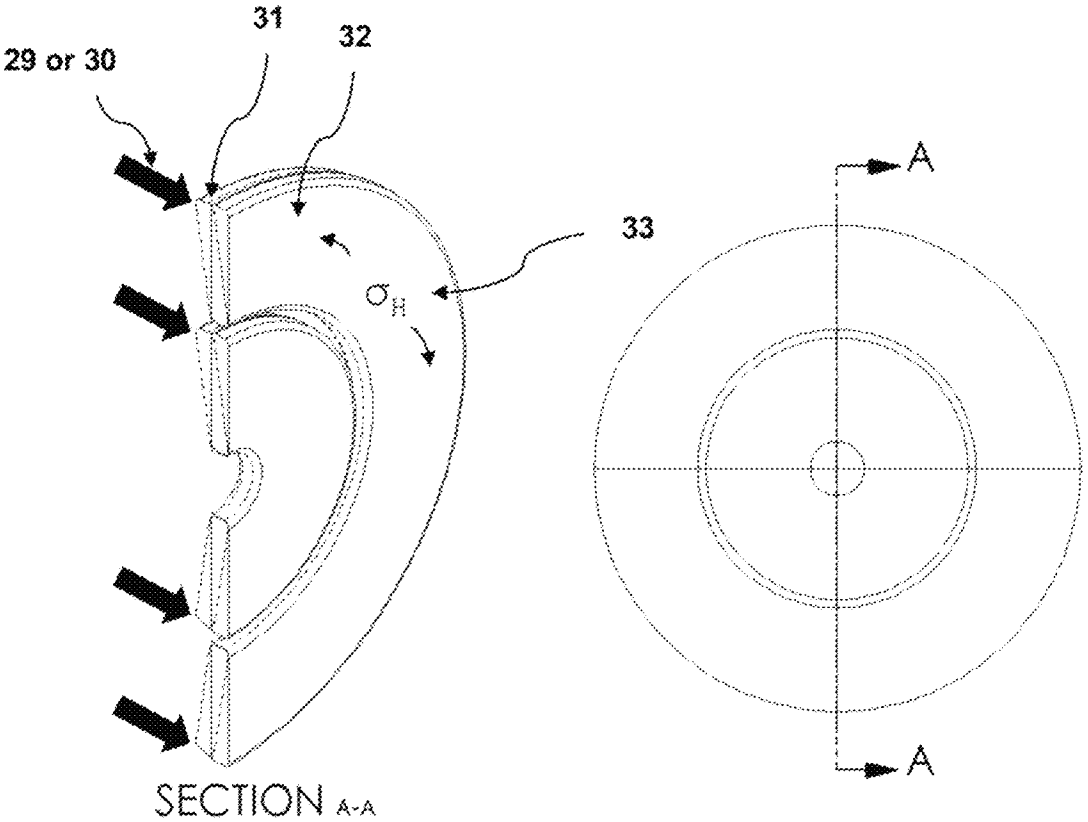
FIG. 7 depicts a single dual concentric disc distortion under full compression loading according to embodiments of the present disclosure.
Figure 8:
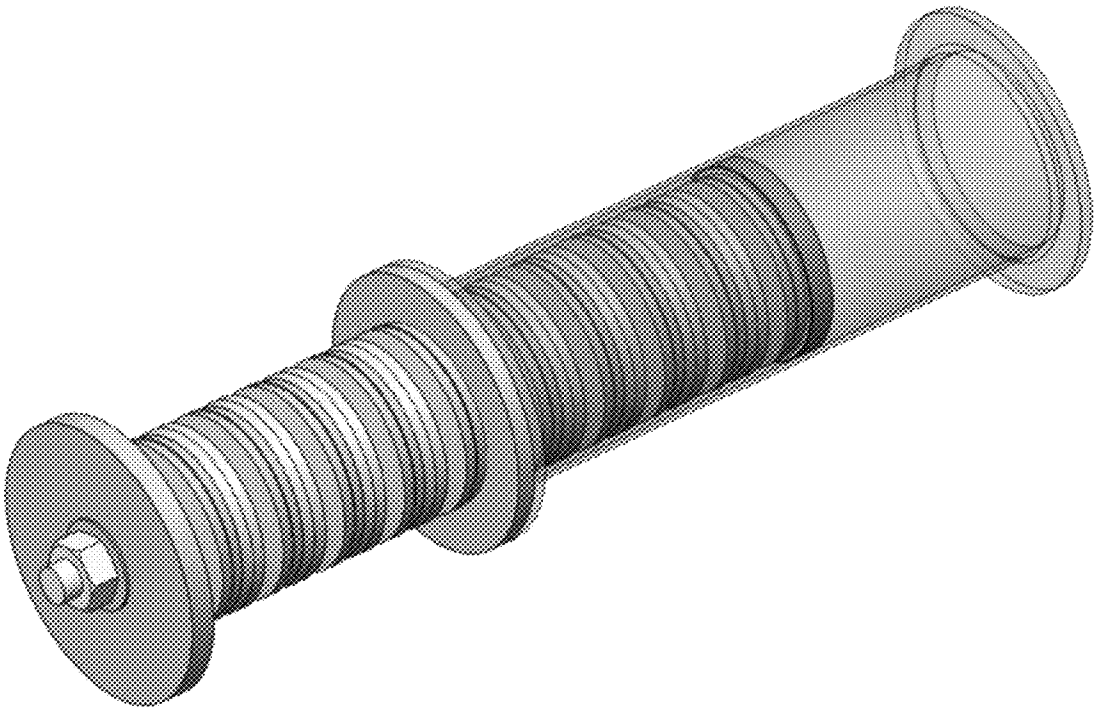
FIG. 8 depicts a single compression dampener according to an embodiment of the present disclosure.
Figure 9:
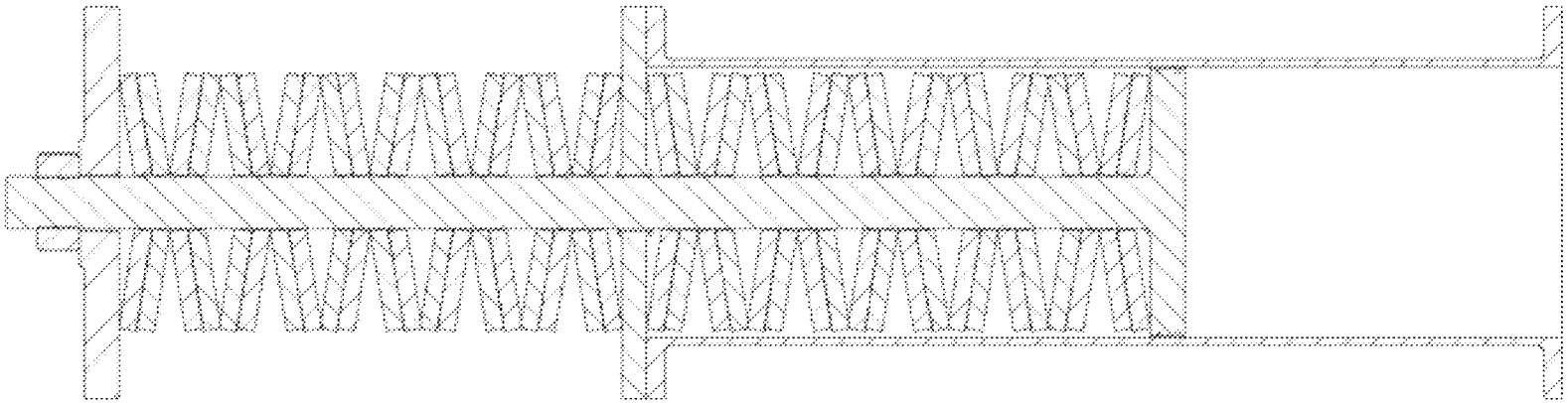
FIG. 9 is a cross-sectional view of the single compression dampener of FIG. 8.
Figure 10:
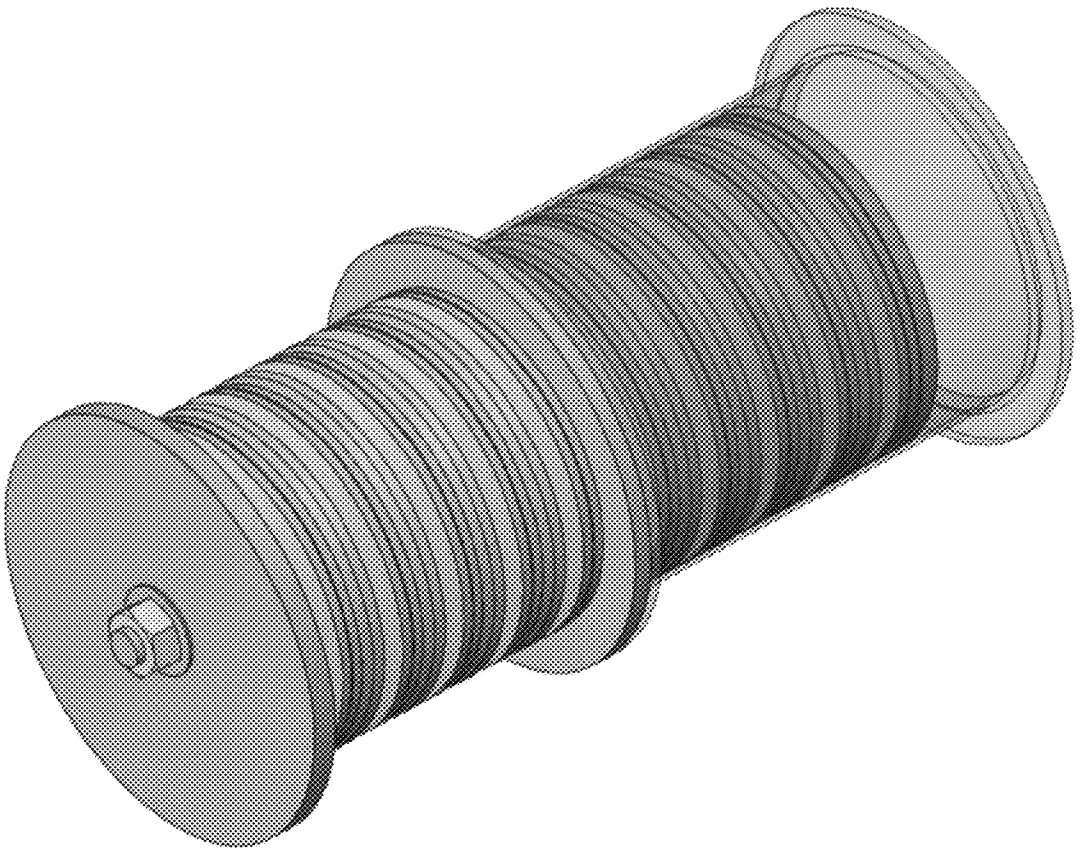
FIG. 10 depicts a dual compression dampener according to an embodiment of the present disclosure.
Figure 11:
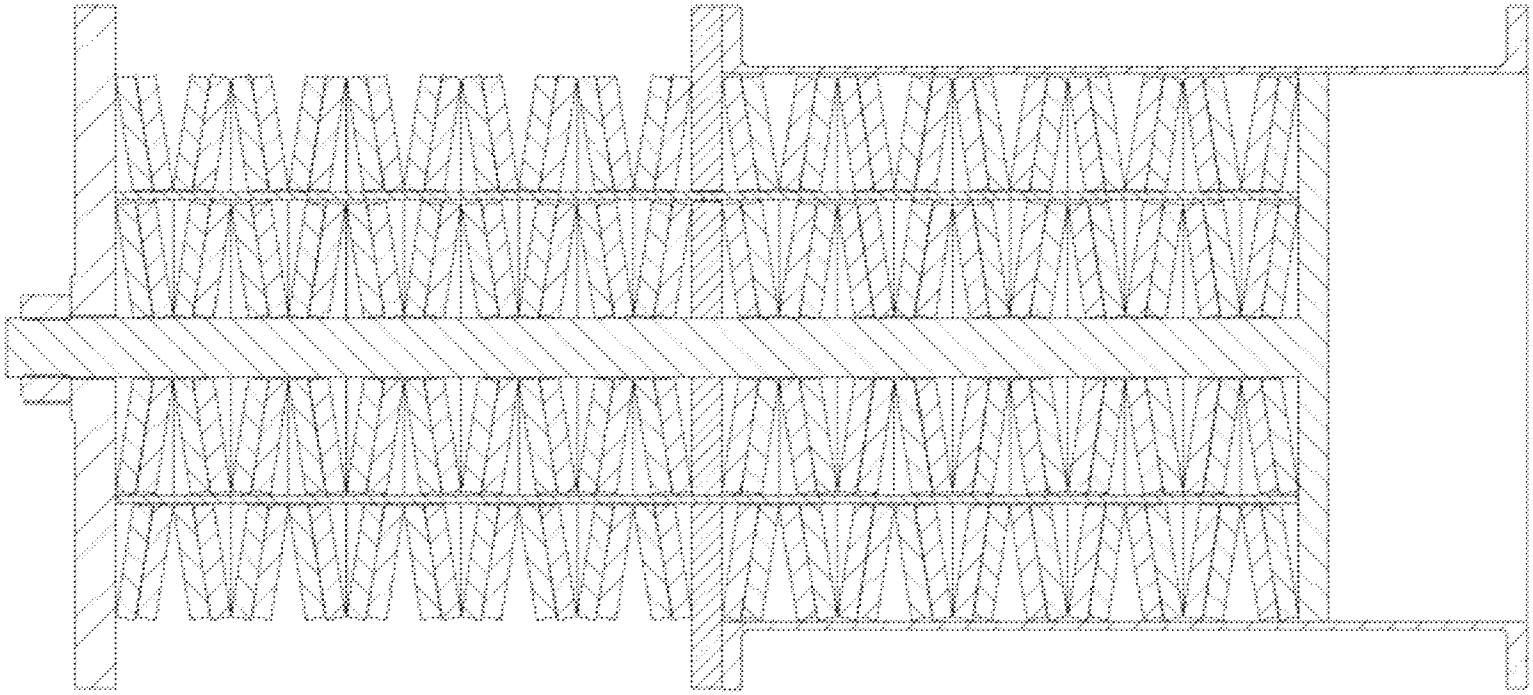
FIG. 11 is a cross-sectional view of the dual compression dampener of FIG. 10.
Figure 12:
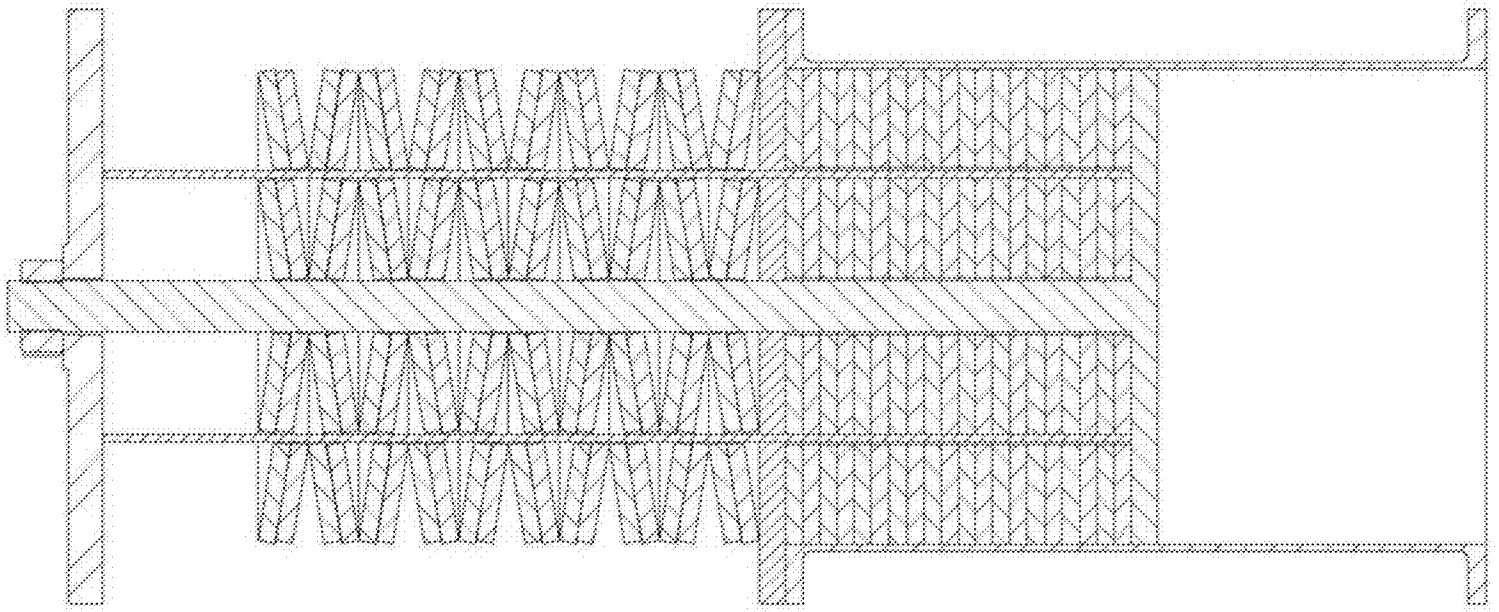
FIG. 12 depicts an extended dual dampener in a tension cycle according to an embodiment of the present disclosure.
Figure 13:
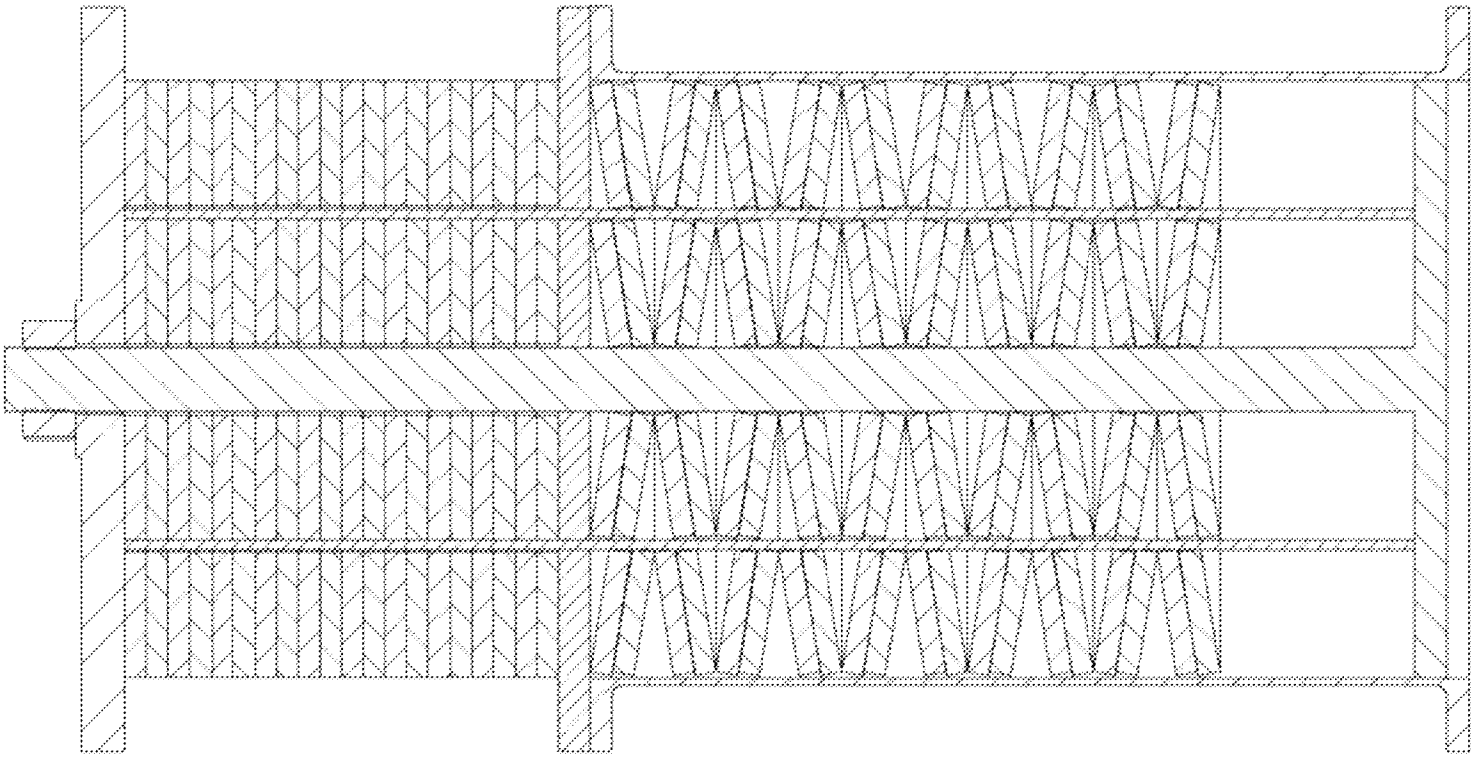
FIG. 13 depicts a compressed dual dampener in a compression cycle according to an embodiment of the present disclosure.

FIG. 7 illustrates a section view of a single set of concentric discs from the dual concentric dampener 17 embodiment with a hidden line representation of the undeformed geometry 31 and a solid line representation of the final compressed geometry 32. Accordingly, FIG. 7 details the distortion of the original disc 31 (represented by hidden lines) to the distorted shape of disc 32 (represented by solid lines), inducing the hoop stress ($\sigma_H$) 33 into the disc material. The presented disclosure embodies the capability of the device, with its multitude of disc cross sections, disc thicknesses, and disc materials, to survive the inducing hoop stress and subsequent energy storage and release, as the devices of the present disclosure dampen and dissipate the loading event.

This notational representation of disc cross sectional geometry by no means limits embodiments of the present disclosure to rectangular sectional geometry. Curvilinear and spline cross sectional contours, with varying thicknesses, are included in the present disclosure, enabling a non-linear and tailorable stiffness response.

During the compression cycle, the disc stack 21 will be allowed to freely move and expand into the cavity created as the tension piston 24 reaches its final compression location. To enhance the free motion of the discs, fillets are utilized on the disc edges which are in contact. This disc embodiment may also include, but are not limited to, varying sized fillets, chamfers, flat surfaces, and other corner features. As the tension load is released, the compressed disc stack 20 expands to its original unstressed position, self-aligning the disclosed dampener.

Referring back to FIG. 6, as the tension cycle forces 30 are applied to the device during a seismic, explosion, or wind event, the disc stack 21 is compressed and the individual concentric discs 27 and 28 are elastically distorted absorbing and dampening the energy. This tension along the axis of the embodiment, in linear-elastic bending, results in induced hoop stress within each individual disc of the disc stack 21, as the discs are distorted, illustrated in FIG. 7. The disc stack 20 will be allowed to freely move and expand into the cavity created as the tension end plate 22 reaches its final tension location. As the tension load is released, the compressed disc stack 21 expands to its original unstressed position, self-aligning the dampener.

According to an embodiment of the present disclosure, an axial dampening device 1 comprises a body constructed of composite, non-metallic and metallic materials, capable of storing energy and dampening building structural seismic, explosion, or wind loads and displacements, utilizing linear-elastic bending and the generation of hoop stress within a multitude of conical discs 6. In some embodiments, axial dampening device 1 reacts and dampens the loading in both tension and compression along the axis of the cross brace in linear-elastic bending, and not through shear of the discs 6 or dampener structure.

In some embodiments, a plurality of parallel and serial conical discs 6 are provided, constituting a disc stack 8, 9 capable of storing energy and dampening building structural loads and displacements. In some embodiments, conical disc 6 is manufactured from composite or metallic materials capable of storing energy as the form of hoop stress without plastic deformation, and the subsequent release of energy self-aligning the disclosed dampener and supported structure.

In some embodiments, composite materials, quasi-isotropic laminates, and quasi-isotropic braided composite fibers are used in fabrication of conical disc 6 energy storage devices for improved structural dampening.

In some embodiments, disc 6 includes an edge design configuration, and disc stack 8, 9 include contact locations that incorporate varying sized fillets, chamfers, flat surfaces, and other corner features to facilitate freedom of motion of the disc stack during cyclic loading.

In some embodiments, a fully tailorable disc stack 8, 9 of discs 6 is provided in which system stiffness and total displacement can be altered by changing the disc cross sectional geometry, disc thicknesses, conical angle, material, quantity, stacking sequence, and the grouping of parallel and serial discs 6.

In some embodiments, conical disc 6 includes curvilinear and spline cross sectional contours with varying thicknesses, providing a non-linear and tailorable stiffness response.

According to some embodiments of the present disclosure, a dampening system 1 is provided for building structures which operate in the elastic deformation regime, resulting in no permanent set. In some embodiments, dampening system 1 for building structures is self-righting, and requires no realignment or retrofit after exposure to a seismic, explosion, or wind loding event, because it operates in the elastic deformation regime.

In some embodiments, axial dampening device 1 is manufactured from light weight composite materials and the approach to dampening the energy within the building that eliminates the need for a heavy weight, concrete filled, buckling restrained brace cylindrical restraint collar or column. The integration of composite materials and elimination of the cylindrical restraint collar provides substantial weight savings, resulting in significant transportation and handling cost savings. A significantly lighter weight dampening device 1 reduces the installation costs of retrofitting existing buildings to meet updated seismic codes.

According to some embodiments of the present disclosure, a pre-load disc compression device 12, 16 provides stability to the dampening device allowing it to withstand daily building wind loading and brace bending moments during intermittent seismic events.

In some embodiments, an integrated tension piston 12 and sliding bearing ring device 14 are provided that react brace shear and bending moments during a loading event.

In some embodiments, an axial dampening device 1 is provided that can easily be removed and replaced, if damaged, without removal of the entire dampening brace, saving time and maintenance costs.

In alternative embodiments, an axial dampening device 17 with a multitude of concentric discs is provided. In some embodiments, concentric disc axial dampening device 17 provides an increased load capacity with improved load distribution within the dampener. In some embodiments, dampening device 17 provides an increased load capacity and is designed to reacted seismic, explosion, and wind loading in only tension, or only compression, based on the required dampening brace. In some embodiments, dampening device 17 provides an increased load capacity and reacts seismic, explosion, and wind loading in combination with seismic Buckling Restrained Braces (BRB), to enhance BRB brace's capability to react the lower loading due to wind and wind gusts.

In some embodiments, a multitude of alignment rods or curvilinear plates 26 are incorporated into the axial dampening device 17, maintaining the concentric position of the outer discs.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A dampening device comprising:

a shaft having an axis, a first end plate, a center plate, and a second end plate;

an outer housing;

a first plurality of discs disposed coaxially to form a first disc stack disposed along the shaft between the first end plate and the center plate, the first disc stack being concentric to the axis an in contact with the first end plate and the center plate, a second plurality of discs disposed coaxially to form a second disc stack disposed along the shaft between the center plate and the second end plate, the second disc stack being concentric to the axis, disposed within the outer housing, and in contact with the center plate and the second end plate, wherein:

the first plurality of discs and the second plurality of discs each comprising fibers within a polymer resin matrix, the fibers comprising carbon, aramid, or glass, and each disc of the first plurality of discs and the second plurality of discs having a concave surface and an opposing convex surface, the first plurality of discs and the second plurality of discs are disposed in pairs such that the convex surfaces of alternating pairs are oriented in substantially opposed directions, and the brace is adapted to dampen loading in both tension and compression along the single central axis in linear-elastic bending, and not through shear of the discs.

2. The device of claim 1, wherein:

the second end plate adapted to move coaxially with the disc stack relative to the center plate.

3. The device of claim 2, wherein the first end plate and the second end plate are coaxially connected.

4. The device of claim 2, further comprising:

a first end connection disposed on the first end plate and adapted to connect to a first structural member of a building;

a second end connection disposed on an end of the device opposite the first end connection and adapted to connect to a second structural member of a building.

5. The device of claim 4, wherein the second end connection is disposed on the outer housing.

6. The device of claim 1, wherein the plurality of discs are substantially conical.

7. The device of claim 1, wherein, in an unloaded configuration, the first disc stack has a first height and the second disc stack has a second height and, in tension, the first height is increased and the second height is decreased.

8. The device of claim 7, wherein, in compression, the first height is decreased and the second height is increased.

9. The device of claim 1, wherein the first disc stack is unenclosed and the second disc stack is disposed entirely within the outer housing.

10. The device of claim 1, wherein the outer housing comprises a low friction polymer disposed on an inner surface, the inner surface being in contact with the second end plate.

* * * * *